US005254275A

United States Patent [19]

Beltzer et al.

[11] Patent Number: 5,254,275

[45] Date of Patent: Oct. 19, 1993

[54] LUBRICATING OIL CONTAINING AN O-ALKYL-N-ALKOXYCARBONYLTHIONOCARBAMATE (PNE-633)

[75] Inventors: Morton Beltzer; Jacob J. Habeeb, both of Westfield, N.J.; Karla S. Colle, Houston, Tex.

[73] Assignee: Exxon Research and Engineering Company, Florham Park, N.J.

[21] Appl. No.: 912,539

[22] Filed: Jul. 13, 1992

Related U.S. Application Data

[63] Continuation-in-part of Ser. No. 805,757, Dec. 12, 1991, abandoned.

[51] Int. Cl.[5] ..... G01M 135/18

[52] U.S. Cl. ..... 252/47.5; 252/78.1; 252/405; 252/406

[58] Field of Search ..... 252/47.5

[56] References Cited

U.S. PATENT DOCUMENTS

| | | | |
|---|---|---|---|
| Re. 32,786 | 11/1988 | Fu et al. | 560/148 |
| 2,673,839 | 3/1954 | Kirshenbaum et al. | 252/47.5 |
| 4,225,450 | 9/1980 | Rosenberger | 252/47.5 |
| 4,556,483 | 12/1985 | Fu et al. | 560/148 |
| 4,659,853 | 4/1987 | Fu et al. | 560/148 |
| 5,084,195 | 1/1992 | Camenzind et al. | 252/47.5 |

FOREIGN PATENT DOCUMENTS 0376889 7/1990 European Pat. Off. .

OTHER PUBLICATIONS

Chem. Abstract, 114 (14): 125 696K.

*Primary Examiner*—Ellen M. McAvoy

*Attorney, Agent, or Firm*—John W. Ditsler; James H. Takemoto

[57] ABSTRACT

The addition of an O-alkyl-N-alkoxycarbonylthionocarbamate to a lubricating oil imparts antiwear, antioxidant and/or friction reducing performance to the oil.

10 Claims, 1 Drawing Sheet

LUBRICATING OIL CONTAINING AN O-ALKYL-N-ALKOXYCARBONYLTHIONOCARBAMATE (PNE-633)

This is a continuation-in-part of U.S. Ser. No. 805,757 filed Dec. 12, 1991, now abandoned.

BACKGROUND OF THE INVENTION

1. Field of the Invention

This invention relates to a lubricating oil composition having good antiwear, antioxidant and/or friction reducing performance due to the presence of an O-alkyl-N-alkoxycarbonylthionocarbamate.

2. Description of Related Art

Engine lubricating oils require the presence of additives to protect the engine from wear. For almost forty years, the principal antiwear additive for engine lubricating oils has been zinc dialkyldithiophosphate (ZDDP). Typically, ZDDP must be used in concentrations of about 1.0 to 1.4 wt. % or greater to be effective in reducing wear. However, phosphates may cause the deactivation of emission control catalysts used in automotive exhaust systems. In addition, ZDDP alone does not provide the enhanced antiwear protection necessary in oils used to lubricate today's small, high performance engines. Furthermore, ZDDP also adds to engine deposits which cause increased oil consumption and increased particulate and regulated gaseous emissions. Accordingly, reducing or eliminating the amount of phosphorus-containing additives (such as ZDDP) in the oil would be desirable.

O-alkyl-N-alkoxycarbonylthionocarbamates and their method of preparation are known (See U.S. Pat. No. 4,659,853, the disclosure of which is incorporated herein by reference). However, no mention is made of using O-alkyl-N-alkoxycarbonylthionocarbamates in a lubricating oil.

SUMMARY OF THE INVENTION

In one embodiment, this invention concerns a lubricating oil composition which comprises (a) a lubricating oil basestock, and (b) an O-alkyl-N-alkoxycarbonylthionocarbamate having the formula

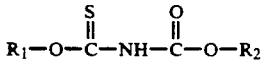

where $R_1$ is a hindered phenol of the formula

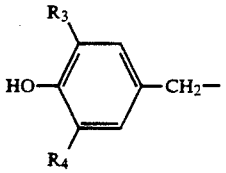

or an aniline moiety of the formula

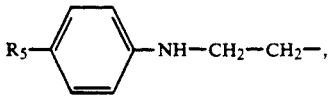

$R_2$ is an alkyl group, an aryl group, an alkaryl group, an arylalkyl group, or substituted derivatives thereof, containing from 1 to 20 carbon atoms, $R_3$ and $R_4$ are alkyl containing from 1 to 12 carbon atoms, and $R_5$ is alkyl containing from 2 to 12 carbon atoms.

In another embodiment, this invention concerns a method for improving the antiwear, antioxidant and/or friction reducing performance of an internal combustion engine by lubricating the engine with an oil containing the O-alkyl-N-alkoxycarbonylthionocarbamate described above. In yet another embodiment, this invention concerns an additive concentrate containing the above-described O-alkyl-N-alkoxycarbonylthionocarbamate that is suitable for blending with a lubricating oil.

DETAILED DESCRIPTION OF THE INVENTION

Figure 1:
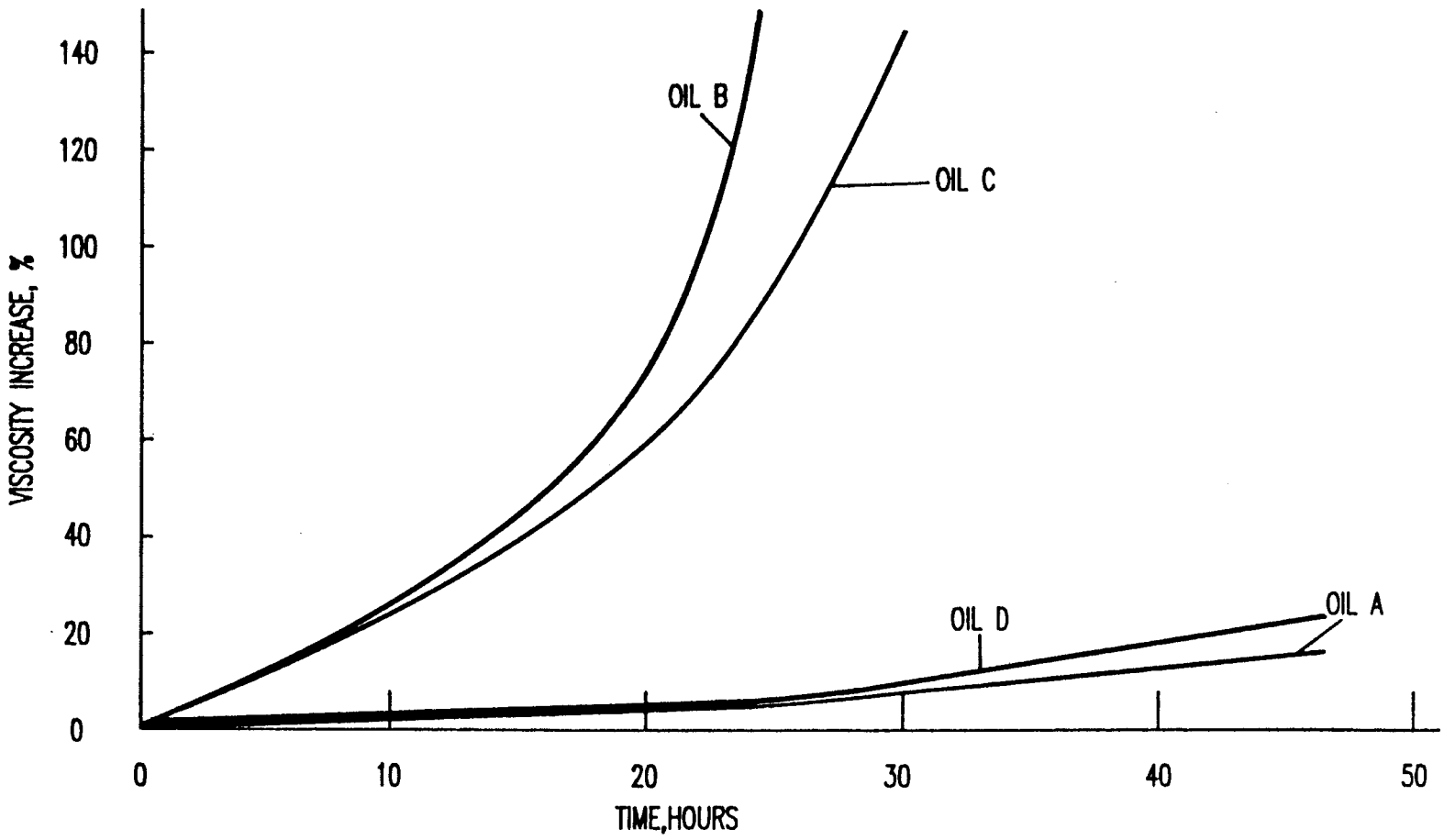
FIG. 1 shows the results of accelerated oxidation tests on oils A–D as a function of percent viscosity increase versus time.

This invention requires a lubricating oil basestock and an oil soluble O-alkyl-N-alkoxycarbonylthionocarbamate.

In general, the lubricating oil will comprise a major amount of a lubricating oil basestock (or base oil) and a minor amount of an O-alkyl-N-alkoxycarbonylthionocarbamate.

The lubricating oil basestock can be derived from natural lubricating oils, synthetic lubricating oils, or mixtures thereof. In general, the lubricating oil basestock will have a kinematic viscosity ranging from about 5 to about 10,000 cSt at 40° C., although typical applications will require an oil having a viscosity ranging from about 10 to about 1,000 cSt at 40° C.

Natural lubricating oils include animal oils, vegetable oils (e.g., castor oil and lard oil), petroleum oils, mineral oils, and oils derived from coal or shale.

Synthetic oils include hydrocarbon oils and halo-substituted hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes), etc., and mixtures thereof); alkylbenzenes (e.g. dodecylbenzenes, tetradecylbenzenes, dinonylbenzenes, di(2-ethylhexyl)benzene, etc.); polyphenyls (e.g. biphenyls, terphenyls, alkylated polyphenyls, etc.); alkylated diphenyl ethers, alkylated diphenyl sulfides, as well as their derivatives, analogs, and homologs thereof; and the like.

Synthetic lubricating oils also include alkylene oxide polymers, interpolymers, copolymers and derivatives thereof wherein the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and polycarboxylic esters thereof (e.g., the acetic acid esters, mixed $C_3$–$C_8$ fatty acid esters, and $C_{13}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, pentaerythritol monoethylether, and the like.

Silicon-based oils (such as the polyakyl-, polyaryl-, polyalkoxy-, or polyaryloxy-siloxane oils and silicone oils) comprise another useful class of synthetic lubricating oils. These oils include tetraethyl silicone, tetraisopropyl silicone, tetra-(2-ethylhexyl) silicone, tetra-(4-methyl-2-ethylhexyl) silicone, tetra(p-tert-butylphenyl) silicone, hexa-(4-methyl-2-pentoxy)-disiloxane, poly(-methyl)-siloxanes and poly(methylphenyl) siloxanes, and the like. Other synthetic lubricating oils include liquid esters of phosphorus-containing acids (e.g., tricresyl phosphate, trioctyl phosphate, diethyl ester of decylphosphonic acid), polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

The O-alkyl-N-alkoxycarbonylthionocarbamates used in this invention are oil soluble and have the general formula:

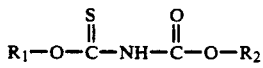

where $R_1$ is a hindered phenol of the formula

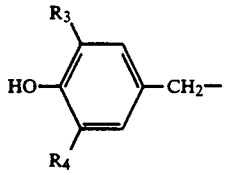

or an aniline moiety of the formula

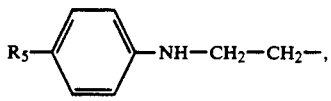

$R_2$ is an alkyl group (straight, branched, or cyclic), an aryl group, an alkaryl group, an arylalkyl group, or substituted derivatives thereof, containing from 1 to 20 carbon atoms, and $R_3$ and $R_4$ are alkyl containing from 1 to 12 carbon atoms, $R_5$ is alkyl containing from 2 to 12 carbon atoms.

Preferably $R_3$ and $R_4$ are alkyl containing from 3 to 8 carbon atoms, especially t-butyl. Preferably $R_5$ is alkyl containing from 3 to 10 carbon atoms. Preferably, $R_2$ is a straight alkyl group containing from 1 to 15 carbon atoms, more preferably from 2 to 8 carbon atoms, and most preferably from 2 to 4 carbon atoms. $R_1$ and $R_2$ may be the same or different, but together should contain a sufficient number of carbon atoms such that the O-alkyl-N-alkoxycarbonylthionocarbamate is soluble in the oil. Preferably, $R_2$ will be different from $R_1$. Examples of suitable substituted groups in $R_2$ include alkyl, aryl, hydroxy, alkylthio, amido, amino, keto, ether, ester groups, thio, and the like, with hydroxy being a preferred substituted group.

The O-alkyl-N-alkoxycarbonylthionocarbamates of the invention are trifunctional, i.e., antiwear, antioxidant and friction reducing properties are combined in a single molecule. This has the advantages of ease of formulation, reduction in additive compatability problems, lower component inventory with fewer components necessary, and reduced mutual antagonisms wherein one component reduces effectiveness of another component.

The amount of O-alkyl-N-alkoxycarbonylthionocarbamate used in this invention need be only an amount which is necessary to impart antiwear, antioxidant and/or friction reducing performance to the oil, i.e., a wear, antioxidant and/or friction reducing amount. Typically, however, the concentration of the O-alkyl-N-alkoxycarbonylthionocarbamate in the lubricating oil will range from about 0.1 to about 5 wt. %, preferably from about 0.4 to about 1.5 wt. %, of the oil.

If desired, other additives known in the art may be added to the lubricating oil basestock. Such additives include dispersants, other antiwear agents, other antioxidants, corrosion inhibitors, detergents, pour point depressants, extreme pressure additives, viscosity index improvers, other friction modifiers, and the like. These additives are typically disclosed, for example, in "Lubricant Additives" by C. V. Smalhear and R. Kennedy Smith, 1967, pp. 1–11 and in U.S. Pat. No. 4,105,571, the disclosures of which are incorporated herein by reference.

O-alkyl-N-alkoxycarbonylthionocarbamates are prepared by methods well known to those skilled in the art. A general method of preparation is illustrated as follows using 2,6-di-t-butyl-4-hydroxybenzylphenol as the hindered phenol:

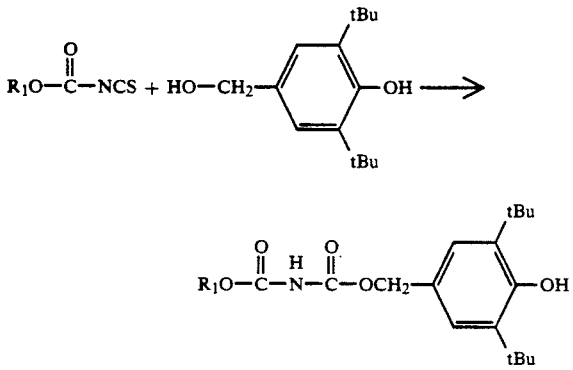

The resulting product is O-(3,5-di-t-butyl-4-hydroxybenzyl)-N-ethoxylcarbonylthionocarbamate, which is a preferred additive.

O-alkyl-N-alkoxycarbonylthionocarbamates containing an aniline moiety are prepared by reacting an aniline compound with ethylene oxide followed by reaction with carbonylisothiocyanate. This reaction is illustrated as follows using 4-hexylaniline

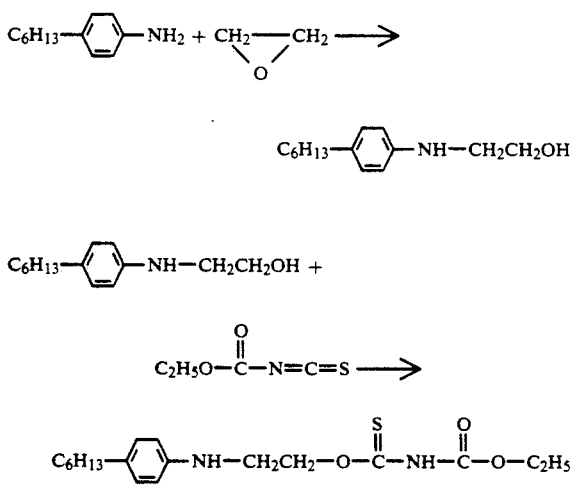

The resulting product is N,N-((bis-2-hydroxyethyl)-4-hexylanilino) ethoxycarbonylthionocarbamate, which is a preferred additive.

The O-alkyl-N-alkoxycarbonylthionocarbamates can be added directly to the lubricating oil. Often, however, they can be made in the form of an additive concentrate to facilitate their handling and introduction into the oil. Typically, the concentrate will contain a suitable organic diluent and from about 10 to about 90 wt. %, preferably from about 30 to about 80 wt. %, of the additives. Suitable organic diluents include mineral oil, naphtha, benzene, toluene, xylene, and the like. The diluent should be compatible (e.g. soluble) with the oil and, preferably, substantially inert.

A lubricating oil containing the O-alkyl-N-alkoxycarbonylthionocarbamates described above can be used in essentially any application where wear protection, antioxidant protection and/or friction reduction is required. Thus, as used herein, "lubricating oil" (or "lubricating oil composition") is meant to include automotive lubricating oils, industrial oils, gear oils, transmission oils, and the like. In addition, the lubricating oil composition of this invention can be used in the lubrication system of essentially any internal combustion engine, including automobile and truck engines, two-cycle engines, aviation piston engines, marine and railroad engines, and the like. Also contemplated are lubricating oils for gas-fired engines, alcohol (e.g. methanol) powered engines, stationary powered engines, turbines, and the like.

This invention may be further understood by reference to the following examples, which include a preferred embodiment of this invention.

EXAMPLE 1

Antiwear Performance of O-alkyl-N-alkoxycarbonylthionocarbamates

Four Ball Wear tests were performed to determine the effectiveness of various O-alkyl-N-alkoxycarbonylthionocarbamates relative to zinc dialkyldithiophosphate (ZDDP) in reducing wear in various lubricating oils. The Four Ball test used is described in detail in ASTM method D-2266, the disclosure of which is incorporated herein by reference. In this test, three balls are fixed in a lubricating cup and an upper rotating ball is pressed against the lower three balls. The test balls utilized were made of AISI 52100 steel with a hardness of 65 Rockwell C (840 Vickers) and a centerline roughness of 25 nm. Prior to the tests, the test cup, steel balls, and all holders were washed with 1,1,1 trichloroethane. The steel balls subsequently were washed with a laboratory detergent to remove any solvent residue, rinsed with water, and dried under nitrogen.

The Four Ball wear tests were performed at 100° C., 60 kg load, and 1200 rpm for 45 minutes duration. After each test, the balls were washed and the Wear Scar Diameter (WSD) on the lower balls measured using an optical microscope. Using the WSD's, the wear volume (WV) was calculated from standard equations (see Wear Control Handbook, edited by M. B. Peterson and W. O. Winer, p. 451, American Society of Mechanical Engineers [1980]). The percent wear reduction (% WR) for each oil tested was then calculated using the following formula:

$$\% WR = \left[1 - \frac{WV \text{ with additive}}{WV \text{ w/o additive}}\right] \times 100$$

The results of these tests and calculations are shown in Table 1.

TABLE 1

| | Additive | wt. % | Wear Volume ($mm^3 \times 10^4$) and % Wear Reduction of Various ZDDP-Free Lubrication Oils | | | | | |
|---|---|---|---|---|---|---|---|---|
| | | | Oil 1 (1) | | Oil 2 (2) | | Oil 3 (3) | |
| | | | WV | % WR | WV | % WR | WV | % WR |
| — | None | 0.0 | 540 | 0.0 | 395 | 0.0 | 410 | 0.0 |
| I | O-isobutyl-N-ethoxycarbonylthiono-carbamate | 1.0 | 21 | 96.1 | 11 | 97.2 | 7 | 98.3 |
| II | O-isobutyl-N-dodecycloxycarbonyl-thionocarbamate | 1.0 | 26 | 95.2 | — | — | — | — |
| III | O-(3,5-di-t-butyl-4-hydroxybenzyl)-N-ethoxycarbonylthionocarbamate | 1.0 | — | — | 23 | 94.2 | 13 | 96.8 |
| IV | O-2-hydroxyethyl-N-ethoxycarbonyl-thionocarbamate | 0.5 | — | — | 9 | 97.7 | 2 | 99.5 |
| V | O-2-(bis-N-2-hydroxyethyl)-amino-ethyl-N-ethoxycarbonylthiono-carbamate | 1.0 | — | — | 24 | 93.9 | 6 | 98.5 |
| V | Same as prior additive | 0.25 | — | — | — | — | 4 | 99.0 |
| VI | O-2-aminoethyl-N-ethoxycarbonyl-thionocarbamate | 0.5 | — | — | 16 | 95.9 | 15 | 96.3 |
| VII | ZDDP | 1.1 | 23 | 95.7 | 12 | 97.0 | 6 | 98.5 |
| VII | ZDDP | 0.25 | — | — | — | — | 269 | 31.9 |
| VIII | N,N-((bis-2-hydroxyethyl)-4-hexyl-anilino)ethoxycarbonylthionocarbamate | 1.0 | | | 10 | 97.5 | 6 | 98.5 |
| VIII | Same as prior additive | 0.5 | | | | | 3 | 99.3 |
| VIII | Same as prior additive | 0.25 | | | | | 27 | 93.4 |

(1) Oil 1 is a solvent extracted, dewaxed, hydrofined neutral basestock having a viscosity of 32 centistokes at 40° C.
(2) Oil 2 is a commercially available SAE 10W30 automotive engine oil having a maximum absolute viscosity of 3500 centipoises at −20° C. and a kinematic viscosity between 9.3 and 12.5 cSt at 100° C. Oil 2 contains 80 wt. % of Oil 1 as basestock and 20 wt. % of conventional lubricating oil additives including detergents, dispersants, VI improvers, antioxidants, antifoaming agents, etc., but no ZDDP.
(3) Oil 3 is a commercially available SAE 10W30 automotive engine oil having a maximum absolute viscosity of 3500 centipoises at −20° C. and a kinematic viscosity between 9.3 and 12.5 cSt at 100° C. Oil 3 contains 9.5 wt. % of Oil 1, 17.8 wt. % of a basestock having a kinematic viscosity of 129 cSt (or 600 SUS) at 40° C., 50 wt. % of a polyalphaolefin having a viscosity of 6 cSt (or 45 SUS) at 40° C., and 22.7 wt. % of the conventional lubricating oil additives mentioned in (2) above, but no ZDDP.

The data in Table I show that O-alkyl-N-alkoxycarbonylthionocarbamates impart comparable antiwear performance to lubricating oils as does ZDDP. Thus, the use of O-alkyl-N-alkoxycarbonylthionocarbamates allows the formulation of a lubricating oil having effective antiwear performance but without the presence (or with a reduced amount) of phosphorus containing compounds such as ZDDP.

EXAMPLE 2

Friction Reducing Performance of O-alkyl-N-alkoxycarbonylthionocarbamates

Ball on Cylinder (BOC) friction tests were performed on several samples of Oil (1) from Example 1 containing some of the O-alkyl-N-alkoxycarbonylthionocarbamates tested in Example 1. The BOC tests were performed using the experimental procedure described by S. Jahanmir and M. Beltzer in ASLE Transactions, 29, No. 3, p. 425 (1985) except that a force of 0.8 Newtons (1 Kg) rather than 4.9 Newtons was applied to a 12.5 mm steel ball in contact with a rotating steel cylinder having a 43.9 mm diameter. The cylinder rotates inside a cup containing a sufficient quantity of lubricating oil to cover 2 Mm of the bottom of the cylinder. The cylinder was rotated at 0.25 rpm. The frictional force was continuously monitored by means of a load transducer. In the tests conducted, friction coefficients attained steady state values after 7 to 10 turns of the cylinder. Friction experiments were run at an oil temperature at 100° C. The results of these tests are shown in Table 2 below.

TABLE 2

| Additive | Wt. % | BOC Friction Coefficient |
|---|---|---|
| None | — | 0.300 |
| I | 1.0 | 0.110 |
| I | 2.0 | 0.110 |

TABLE 2-continued

| Additive | Wt. % | BOC Friction Coefficient |
|---|---|---|
| II | 1.0 | 0.155 |
| II | 2.0 | 0.100 |
| II | 3.0 | 0.095 |
| III | 1.0 | 0.153 |
| VIII | 1.0 | 0.053 |

The data in Table 2 show that the presence of O-alkyl-N-alkoxycarbonylthionocarbamates improves the friction reducing performance of a lubricating oil.

EXAMPLE 3

Accelerated Oxidation Test

This test is performed by heating oil samples to 172° C. and aerating the sample at a rate of I liter/min. Test duration is 46 hrs. The stability of the oil is rated by determining viscosity prior to and after oxidation periods. Viscosity is the kinematic viscosity at 40° C.

Accelerated oxidation tests were carried out with the following oils:

Oil A—Superflo Supreme, a fully formulated commercial passenger car engine oil.

Oil B—Oil A without ZDDP and with half the supplementary antioxidant removed.

Oil C—Oil B with 2 wt.% of O-isobutyl-N-ethoxycarbonylthionocarbamate,

Oil D—Oil B with 2 wt.% of O-(3,5-di-t-butyl-4-hydroxybenzyl)-N-ethoxycarbonylthionocarbamate.

The results of the accelerated oxidation tests on the above oils are shown in the Figure as a function of percent viscosity increase as a function of time. With reference to the Figure, Oil A readily passes, incurring a 12% viscosity increase after 46 hrs. Oil B, suffered a 140% viscosity increase after 23 hrs. and was too viscous to measure by the end of the test. Similarly, Oil C's viscosity increased rapidly with an unmeasurable viscosity by the end of the test. By contrast Oil D is very similar to Oil A and passes with little viscosity change as compared to Oil A thereby confirming that Oils A & D have similar antioxidant properties.

These results demonstrate that the O-alkyl-N-alkoxycarbonylthionocarbamate of the invention containing a hindered phenol moiety provides antioxidant properties whereas the o-alkyl counterpart exemplified by the isobutyl moiety imparts no antioxidant protection.

EXAMPLE 4

Comparison of Hindered Phenols

Many hindered phenols impart antioxidant properties at room temperature but are not effective in oils at high temperatures. Table 3 shows the behavior of Oil B from Example 3 containing 2 wt.% of various antioxidants in the accelerated oxidation test.

TABLE 3

| Antioxidant in Oil B | % Viscosity Increase at Indicated Test Hours | | | |
|---|---|---|---|---|
| | 3 | 19 | 23 | 46 |
| α-tocopherol | 0 | 31 | 44 | TVTM* |
| Trolox | 0 | 12 | 20 | TVTM |
| Butylated hydroxytoluene | 0 | 3 | 4 | 129 |
| Butylated hydroxyanisole | 0 | 5 | 22 | 134 |
| none | 0 | 74 | 101 | TVTM |
| phenol | 0 | 85 | 103 | TVTM |
| o-(3,5-di-t-butyl-4-hydroxybenzyl)-N-ethoxycarbonylthionocarbamate | 0 | 0 | 0 | 23 |

*Too viscous to measure

The results demonstrate that covalently bonding the hindered phenol as a moiety within the overall carbonylthionocarbamate molecule provides antioxidancy properties at high temperatures in oils.

EXAMPLE 5

Compound VIII in Table I of Example 1 was prepared by ethoxylating hexylaniline with ethylene oxide. 2.25 moles of hexylaniline were reacted with 1 mole of ethylene oxide in a Parr bomb at 120° C. until the pressure dropped indicating the reaction was over (30 min). The temperature was raised to 150° C. for 1 hour to ensure completeness of the reaction. The product was vacuum distilled to remove unreacted hexylaniline, and analysis of the product showed N-(bis-2-hydroxyethyl)-4-hexylaniline plus a minor amount of diethoxylated hexylaniline. The ethoxylated hexylaniline was then reacted with ethoxycarbonylisothiocyanate in a 1:1 mole ratio by refluxing in ether for 6 hours to form compound VIII. Ether was removed by vacuum evaporation and the resulting dark oil containing compound VIII was subjected to oxidative differential scanning calorimetry.

Oxidative differential scanning calorimetry (oxidative DSC) is another procedure that assesses the antioxidancy of a lubricating oil. In this DSC test, a sample of oil is heated in air at a programmed rate, e.g., 5° C./minute and the sample temperature rise relative to an inert reference measured. The temperature at which an exothermic reaction (the oxidation onset temperature) is a measure of the oxidative stability of the sample.

For comparative purposes, the DSC tests were conducted on a sample of oil B from Table 1 and oil B containing 1 wt.% of compound VIII.

The results are tabulated below:

| Oil | DSC Oxidation Onset Temp. °C. |
|---|---|
| Oil B | 195 |
| Oil B + 1% Compound VIII | 235 |

These results demonstrate that compound VIII provides antioxidancy protection.

What is claimed is:

1. A lubricating oil composition which comprises (a) a lubricating oil basestock, and (b) an 0-alkyl-N-alkoxycarbonylthionocarbamate having the formula

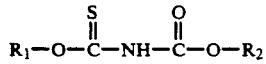

where $R_1$ is a hindered phenol of the formula

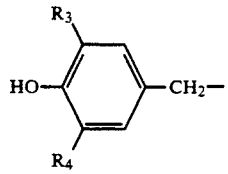

or an aniline moiety of the formula

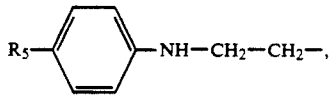

$R_2$ is an alkyl group, an aryl group, an alkaryl group, an arylalkyl group, or substituted derivatives thereof, containing from 1 to 20 carbon atoms, $R_3$ and $R_4$ are each alkyl containing from 1 to 12 carbon atoms, and $R_5$ is alkyl containing from 2 to 12 carbon atoms.

2. The composition of claim 1 wherein $R_3$ and $R_4$ are each $C_3$ to $C_8$ alkyl.

3. The composition of claim 2 wherein $R_3$ and $R_4$ are tertiary butyl.

4. The composition of claim 1 wherein $R_5$ is $C_3$ to $C_8$ alkyl.

5. The composition of claim 1 wherein $R_2$ is $C_1$ to $C_{15}$ straight chain alkyl.

6. The composition of claim 1 wherein the concentration of component (b) is from 0.1 to 5 wt. %, based on oil.

7. A method of improving the antiwear performance, friction reducing performance, or antiwear and friction reducing performance of an internal combustion engine which comprises operating the engine with a lubricating oil comprising a major amount of the lubricating oil basestock and a minor amount of an O-alkyl-N-alkoxycarbonylthionocarbamate of claim 1.

8. The method of claim 7 wherein the O-alkyl-N-alkoxycarbonylthionocarbamate is O-(3,5-di-t-butyl-4hydroxybenzyl)-N-ethoxycarbonylthionocarbamate.

9. An additive concentrate suitable for blending with lubricating oils to provide a lubricating composition having antiwear and friction reducing performance which comprises an organic diluent and from about 10 to about 90 wt. % of the O-alkyl-N-alkoxycarbonylthionocarbamate of claim 1.

10. The concentrate of claim 9 wherein the organic diluent is mineral oil, naphtha, benzene, toluene, or xylene.

* * * * *